US009466272B1

(12) United States Patent
Lin

(10) Patent No.: US 9,466,272 B1
(45) Date of Patent: Oct. 11, 2016

(54) CAJÓN PLAYING DEVICE

(71) Applicant: E BIN INDUSTRIAL CO., LTD., Taichung (TW)

(72) Inventor: Hsi Tan Lin, Taichung (TW)

(73) Assignee: E BIN INDUSTRIAL CO., LTD., Taichung (TW)

( * ) Notice: Subject to any disclaimer, the term of this patent is extended or adjusted under 35 U.S.C. 154(b) by 0 days.

(21) Appl. No.: 15/156,587

(22) Filed: May 17, 2016

(51) Int. Cl.
*G10D 13/02* (2006.01)
*G10D 13/00* (2006.01)

(52) U.S. Cl.
CPC ..... *G10D 13/006* (2013.01)

(58) Field of Classification Search
CPC ..... G10D 13/006
See application file for complete search history.

(56) References Cited

U.S. PATENT DOCUMENTS 1,769,712 A * 7/1930 Pignocco ..... G10D 13/006 84/422.1
1,808,085 A * 6/1931 Troppe ..... G10D 13/006 84/422.1
8,624,097 B1 * 1/2014 Liao ..... G10D 13/006 84/422.1
8,884,145 B1 * 11/2014 Lin ..... G10D 13/006 84/422.1
9,230,522 B1 * 1/2016 Lin ..... G10D 13/006
9,263,010 B2 * 2/2016 Trask ..... G10D 13/025
2013/0276617 A1 * 10/2013 Gunter ..... G10D 13/02 84/422.1
2015/0059555 A1 * 3/2015 Liao ..... G10D 13/003 84/422.1

FOREIGN PATENT DOCUMENTS

DE 202009003513 U1 * 5/2009 ..... G10D 13/006
DE 202010004042 U1 * 7/2010 ..... G10D 13/006
DE 202013006328 U1 * 8/2013 ..... G10D 13/006

* cited by examiner

*Primary Examiner* — Robert W Horn
(74) *Attorney, Agent, or Firm* — Muncy, Geissler, Olds & Lowe, P.C.

(57) ABSTRACT

A cajón playing device consists essentially of a bottom plate, a mallet assembly, and a pedal lever. The mallet assembly is mounted on the bottom plate and has a rotating shaft, a mallet fixedly connected to the rotating shaft so as to pivot simultaneously with the rotating shaft when the rotating shaft is rotated, and a transmission member fixedly connected to the rotating shaft and extending toward the bottom plate. The pedal lever has a middle section pivotally provided on a lateral side of the bottom plate, one end connected to the extending end of the transmission member, and the opposite end bent into a curved foot-operated portion. When the foot-operated portion is operated, the pedal lever is pivoted and drives the transmission member to rotate the rotating shaft such that the mallet fixedly connected to the rotating shaft is pivoted and strikes the striking surface of a cajón.

7 Claims, 13 Drawing Sheets

CAJÓN PLAYING DEVICE

BACKGROUND OF THE INVENTION

1. Technical Field

The present invention relates to a peripheral device of a percussion instrument and more particularly to a cajón playing device.

2. Description of Related Art

FIG. 13 shows a conventional cajón playing device, which includes a striking assembly 91 and a pedal assembly 92. The striking assembly 91 has a shaft base 911, a transverse shaft 912 pivotally provided on the shaft base 911, a mallet 913 provided on the transverse shaft 912, and a clamping device 914 provided at a bottom portion of the shaft base 911 in order to clamp a securing frame 931 and thereby secure the striking assembly 91 to a cajón 93. The pedal assembly 92 includes a bottom plate 921; a pedal 922 and a support 923, both provided on the bottom plate 921; a drive shaft 925 transversely provided on the support 923; and a linking member 924 connected between the drive shaft 925 and the pedal 922 in order to transmit the force applied to the pedal 922 to the drive shaft 925. The transverse shaft 912 and the drive shaft 925 are connected by a cable 94. When stepped on and operated by a user's foot, the pedal 922 drives the drive shaft 925, and consequently the transverse shaft 912 through the cable 94 connected between the drive shaft 925 and the transverse shaft 912, into rotation such that the mallet 913 is swung and strikes the cajón 93.

The conventional cajón playing device described above is so designed that the mallet 913's striking the cajón 93 is enabled by force transmission through the cable 94. However, the pedal assembly 92 not only adds to the number of components and structural complexity of the entire playing device, but also leads to high component costs and a time-consuming, onerous assembly process. In addition, there are limitations on cable arrangement. The cable 94 must not bend excessively, or its transmission function will be compromised. Moreover, since one end of the cable 94 is connected to the transverse shaft 912, where the mallet 913 is provided, the cable 94 is subject to vibrations caused by the striking action of the mallet 913, and the cable end connected to the transverse shaft 912 may break or fall off as a result.

BRIEF SUMMARY OF THE INVENTION

The primary objective of the present invention is to provide a cajón playing device featuring simple and durable components, low production costs, and rapid assembly.

The second objective of the present invention is to provide a cajón playing device adaptable to different users' habitual stepping operations.

To achieve the foregoing objectives, the present invention provides a cajón playing device which includes a bottom plate, a mallet assembly, and a pedal lever.

The bottom plate has a supporting surface. A lateral side of the bottom plate is provided with an outwardly extending extension arm, which has a pivotal connection portion.

The mallet assembly is mounted on the supporting surface of the bottom plate and has two vertically provided posts; a rotating shaft which is pivotally provided between and can pivot with respect to the two posts; an extension spring connected to one end of the rotating shaft so that, once the rotating shaft is rotated from its original position, the extension spring can rotate the rotating shaft reversely back to the original position; a mallet fixedly connected to the rotating shaft so as to pivot simultaneously with the rotating shaft when the rotating shaft is rotated; and a transmission member fixedly connected to the rotating shaft and extending toward the bottom plate.

The pedal lever is pivotally provided on the pivotal connection portion of the extension arm such that the pivotal connection portion serves as a fulcrum of the pedal lever. One end of the pedal lever defines a foot-operated portion to be stepped on and operated by a foot. The opposite end of the pedal lever defines a connecting portion. The connecting portion of the pedal lever is connected to an extending end of the transmission member. The foot-operated portion of the pedal lever is bent toward a rear side of the foot and has a curved shape. When the foot is placed on the foot-operated portion and moves the foot-operated portion up and down, the connecting portion of the pedal lever is pivoted with respect to the pivotal connection portion serving as the fulcrum. Consequently, the transmission member is driven to rotate the rotating shaft, and the mallet fixedly connected to the rotating shaft is pivoted and strikes the striking surface of a cajón.

Preferably, the transmission member is composed of a long, flat, plate-shaped pushrod, one end of the transmission member is pivotally provided on an assembly block of the rotating shaft, and the opposite end of the transmission member extends downward toward the bottom plate and is pivotally connected to the connecting portion of the pedal lever.

Preferably, the transmission member is composed of a chain connected to the rotating shaft and a linking member pivotally provided on the bottom plate. One end of the chain is connected to the rotating shaft while the opposite end of the chain extends downward toward the bottom plate. The linking member has a middle section pivotally provided on a supporting frame of the bottom plate, in order for the two opposite ends of the linking member to pivot with respect to the supporting frame serving as a fulcrum. One of the two opposite ends of the linking member is connected to the end of the chain that extends downward toward the bottom plate. The other end of the linking member is bent toward and connected to the connecting portion of the pedal lever.

Furthermore, the connecting portion of the pedal lever is protrudingly provided with a stem, and the portion of the linking member that is connected to the connecting portion is formed with a slot. The slot corresponds in position to the stem and has a length greater than the diameter of the stem. The stem on the connecting portion of the pedal lever is inserted through the slot of the linking member, and the end of the stem that is exposed through the slot is fastened with a fastener to connect together the connecting portion of the pedal lever and the linking member. In addition, each of the two open ends of the slot has an inner edge formed with a flared surface.

Preferably, the transmission member is composed of a chain connected to the rotating shaft and a linking member pivotally provided on the bottom plate. One end of the chain is connected to the rotating shaft while the opposite end of the chain extends downward toward the bottom plate. The linking member has a first end connected to the end of the chain that extends downward toward the bottom plate and a second end bent toward and pivotally connected to the connecting portion of the pedal lever. A portion of the linking member that is adjacent to the second end is pivotally provided on a supporting frame of the bottom plate so that the first end and the second end of the linking member can pivot with respect to the supporting frame serving as a fulcrum.

Furthermore, the second end of the linking member is located above the connecting portion of the pedal lever and is pivotally connected to the connecting portion via a pivotal connection plate.

Furthermore, one end of the extension arm of the bottom plate is connected to the bottom plate and bent upward to integrally form the supporting frame, and the opposite end of the extension arm extends outward and is bent upward to integrally form the pivotal connection portion.

DETAILED DESCRIPTION OF THE INVENTION

Figure 1:
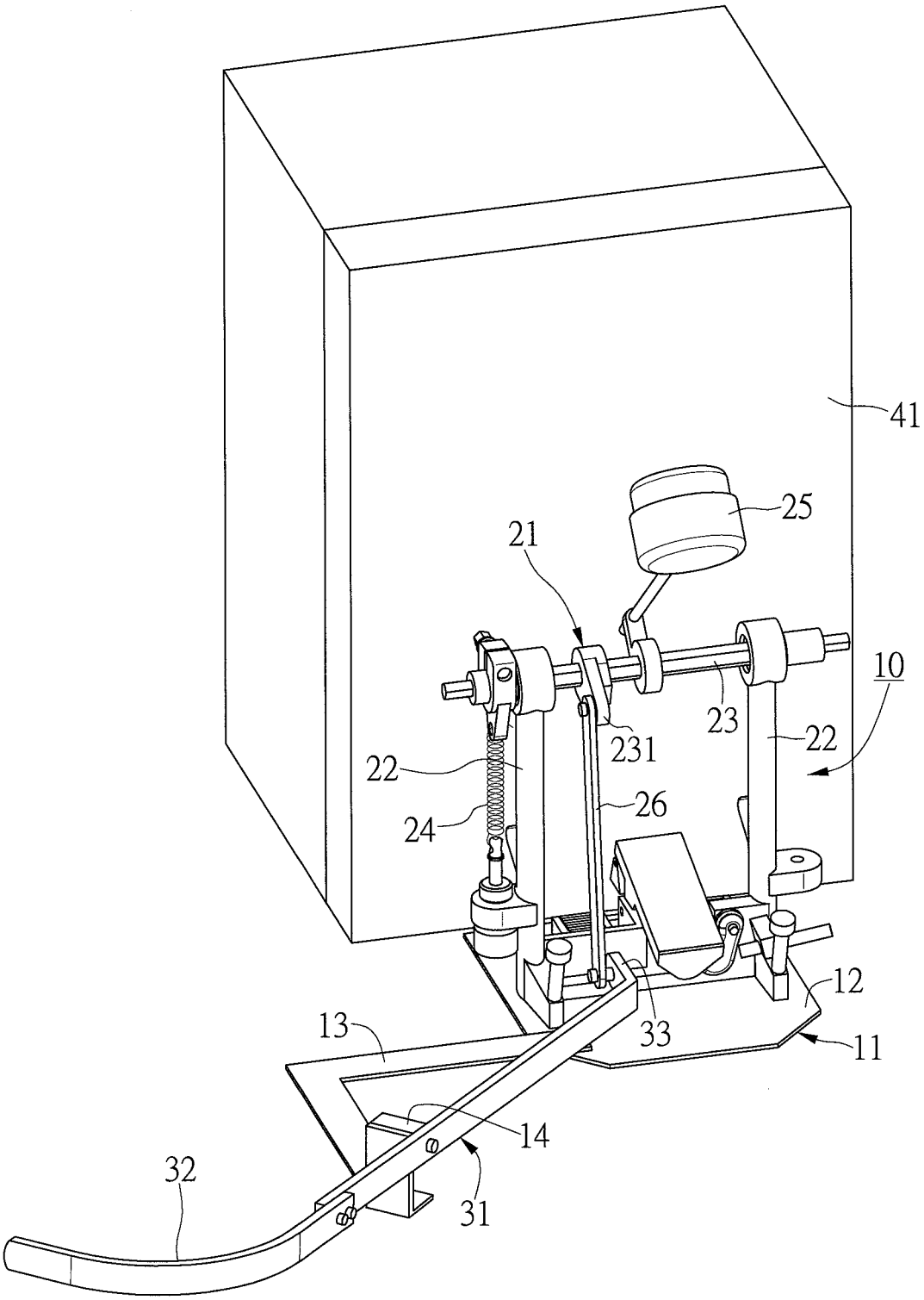
FIG. 1 is a perspective view of the first embodiment of the present invention.
Figure 2:
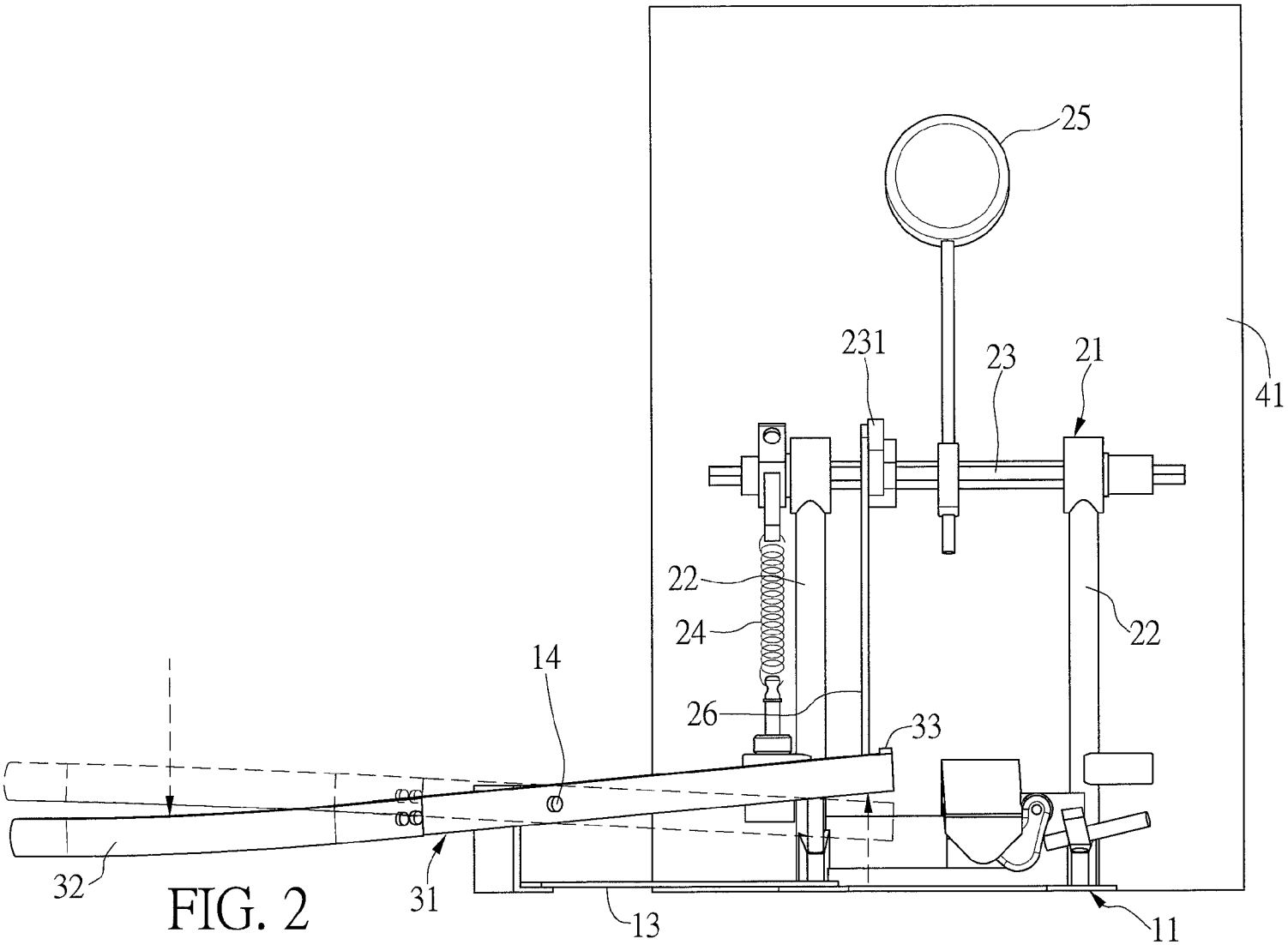
FIG. 2 is a front view showing how the pedal lever in the first embodiment of the present invention is operated.

Referring to FIG. 1 and FIG. 2, the cajón playing device 10 in the first embodiment of the present invention consists essentially of a bottom plate 11, a mallet assembly 21, and a pedal lever 31.

The bottom plate 11, to be placed on the ground in front of the striking surface 41 of a cajón, is plate-shaped and has a supporting surface 12, which faces upward. One lateral side of the bottom plate 11 is connected with an outwardly extending extension arm 13. The extension arm 13 has a pivotal connection portion 14. The aforesaid lateral side of the bottom plate 11 can be either the left- or the right-hand side, depending on which of the user's feet is habitually used to operate the cajón playing device 10. If the user tends to use the right foot, the aforesaid lateral side of the bottom plate 11 is the right-hand side of the bottom plate 11. If the user tends to use the left foot instead, the aforesaid lateral side of the bottom plate 11 is the left-hand side of the bottom plate 11. In the first embodiment, the extension arm 13 is provided on the right-hand side of the bottom plate 11 and extends outward.

The mallet assembly 21 is mounted on the supporting surface 12 of the bottom plate 11 and has two upright posts 22, which are spaced apart from each other. Pivotally provided between the posts 22 is a rotating shaft 23, which can rotate with respect to the posts 22. One end of the rotating shaft 23 is connected with an extension spring 24. Once the rotating shaft 23 is rotated, the extension spring 24 can rotate the rotating shaft 23 in the reverse direction and thereby bring the rotating shaft 23 back to its original position. A mallet 25 is fixedly connected to the rotating shaft 23 so as to pivot simultaneously with the rotating shaft 23 when the rotating shaft 23 is rotated. A transmission member 26 is also fixedly connected to the rotating shaft 23 and extends toward the bottom plate 11. In the first embodiment, the transmission member 26 is composed of a long, flat, plate-shaped pushrod, with one end pivotally provided on an assembly block 231 of the rotating shaft 23 and the other end extending downward toward the bottom plate 11.

The pedal lever 31 is shaped as a long, flat plate and has a middle section pivotally provided on the pivotal connection portion 14 of the extension arm 13, in order for the two opposite ends of the pedal lever 31 to move up and down (i.e., pivot) with respect to the pivotal connection portion 14 serving as a fulcrum. One end of the pedal lever 31 defines a foot-operated portion 32 configured to be stepped on and operated by the user's foot. The other end of the pedal lever 31 defines a connecting portion 33. The connecting portion 33 of the pedal lever 31 is pivotally connected to the downwardly extending end of the transmission member 26. The foot-operated portion 32 of the pedal lever 31 is curved toward the rear side of the user's foot.

Figure 3:
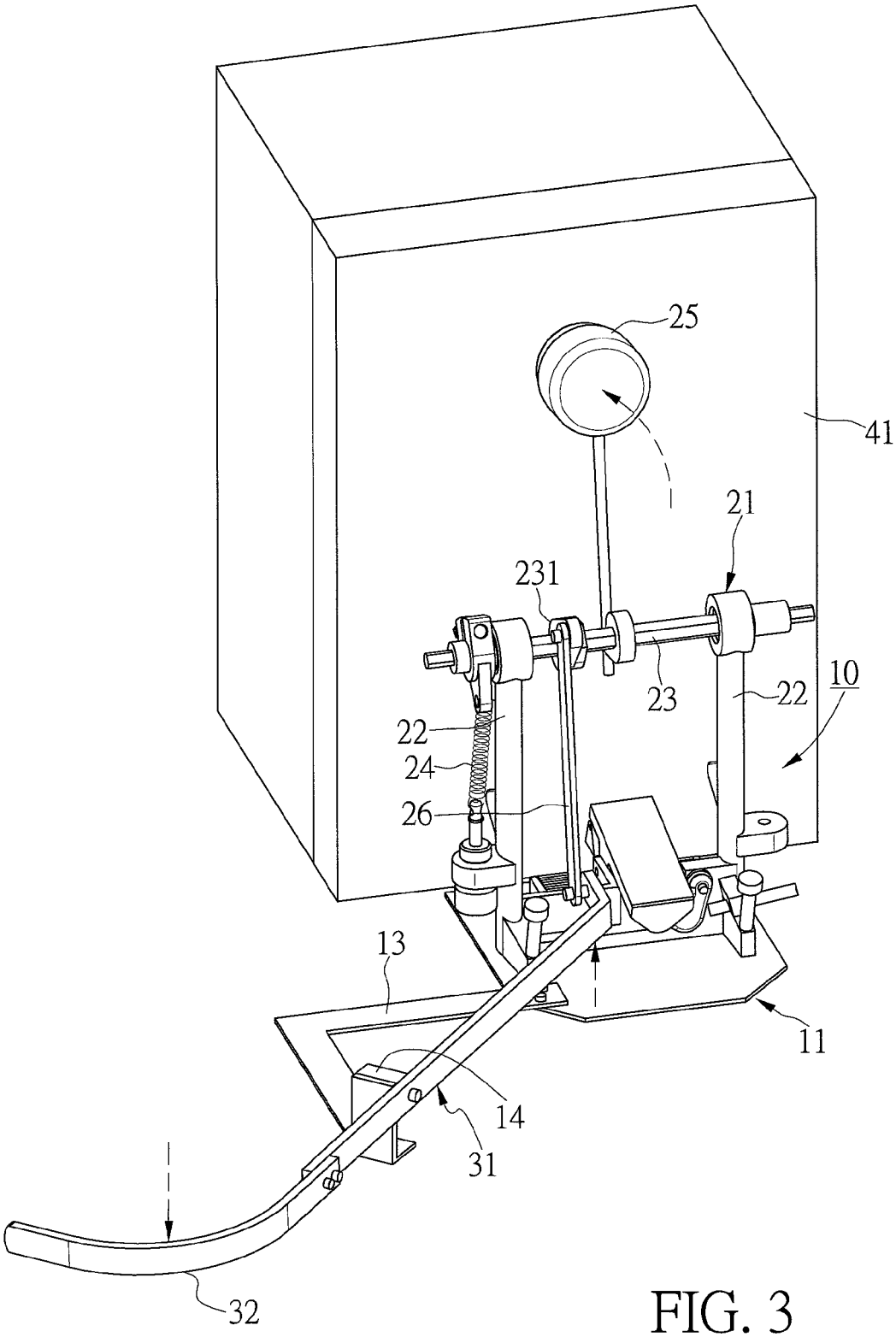
FIG. 3 is a perspective view showing how the pedal lever in the first embodiment of the present invention is operated.

To use the cajón playing device 10 in the first embodiment of the present invention, referring to FIG. 2 and FIG. 3, the user's foot (not shown) steps down onto the curved foot-operated portion 32 of the pedal lever 31 such that the connecting portion 33 of the pedal lever 31 is pivoted upward with respect to the pivotal connection portion 14 serving as a fulcrum. Consequently, the transmission member 26, which is connected to the connecting portion 33, is driven to push the assembly block 231 upward and thereby rotate the rotating shaft 23. The mallet 25 fixedly connected to the rotating shaft 23 is thus pivoted and strikes the striking surface 41 of the cajón.

By comparing the cajón playing device 10 of the present invention with the pedal assembly of a conventional cajón playing device, it can be known that the present invention features more direct force transmission, higher durability, and much simpler components because the transmission member 26 is directly driven to rotate the mallet 25 by the pedal lever 31 pivotally provided on the extension arm 13 of the bottom plate 11. The present invention, therefore, has much lower production costs and allows more rapid and more efficient assembly.

Figure 4:
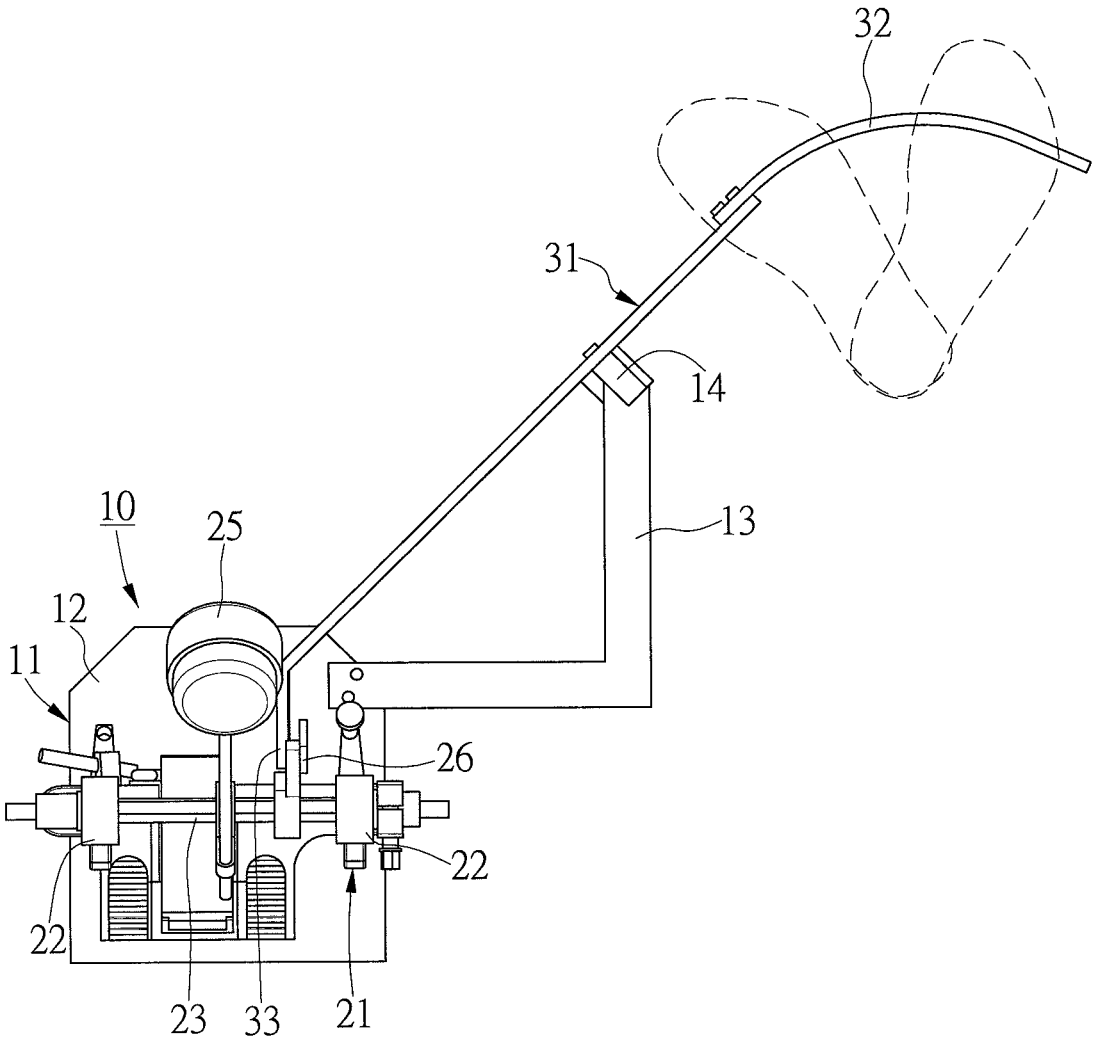
FIG. 4 shows a state of use of the present invention, in particular how the foot-operated portion adapts to different foot placement angles.
Figure 5:
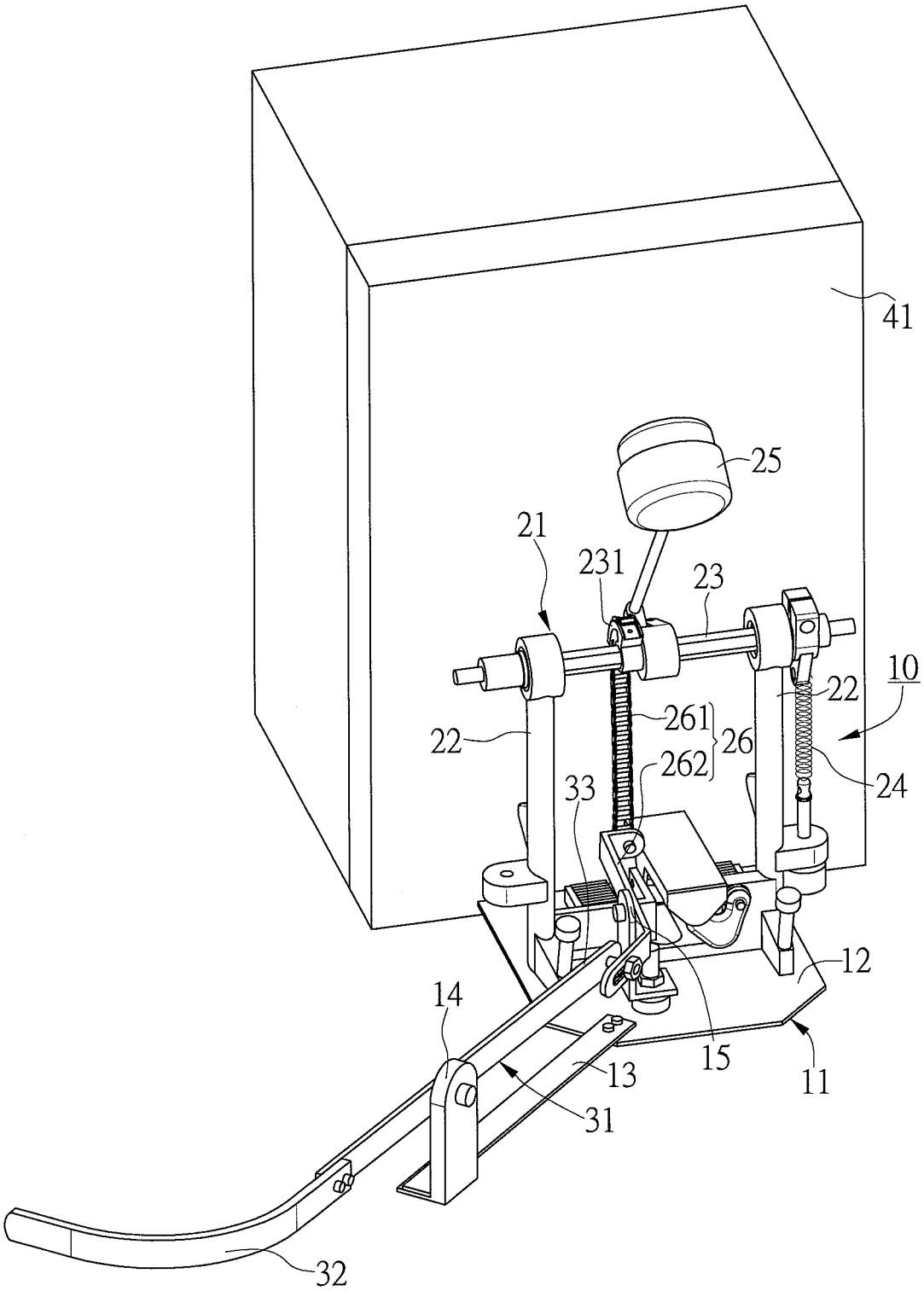
FIG. 5 is a perspective view of the second embodiment of the present invention.
Figure 6:
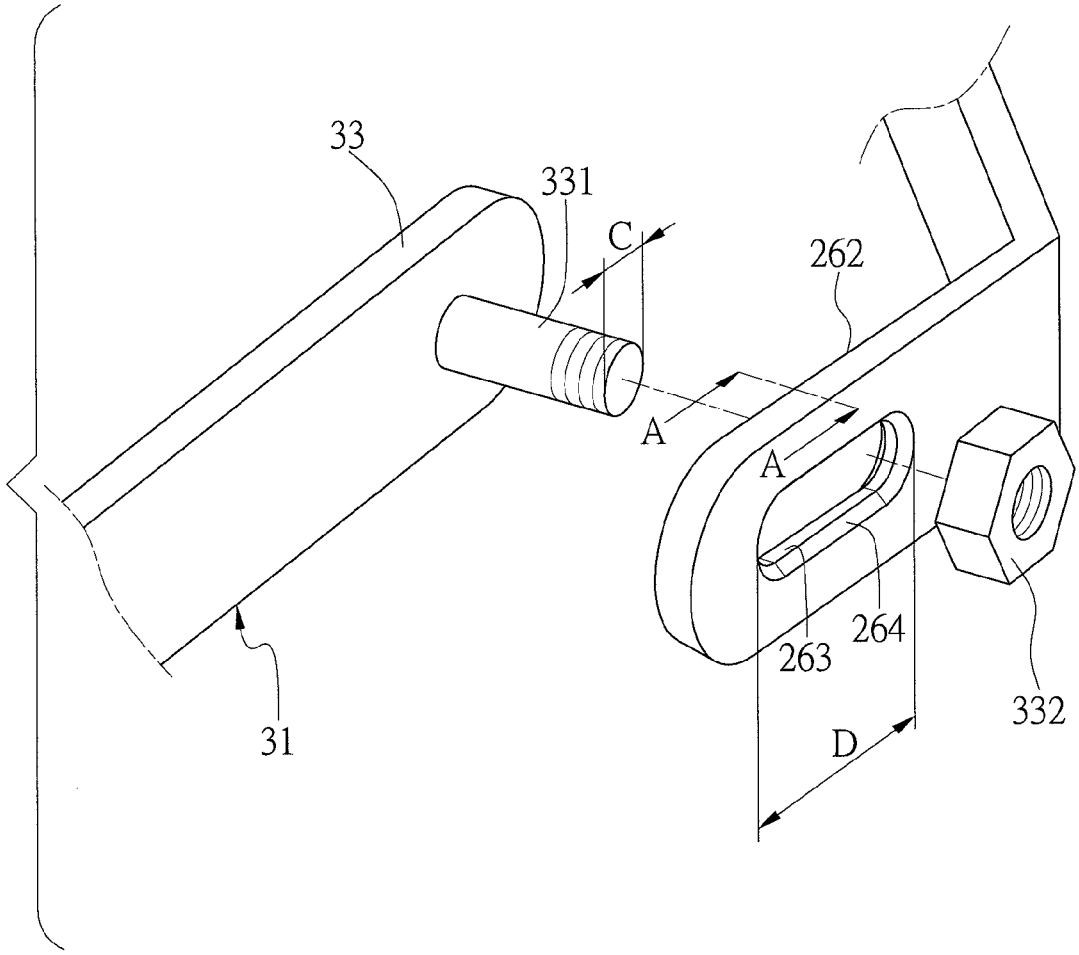
FIG. 6 shows how the pedal lever and the linking member in the second embodiment of the present invention are put together.
Figure 7:
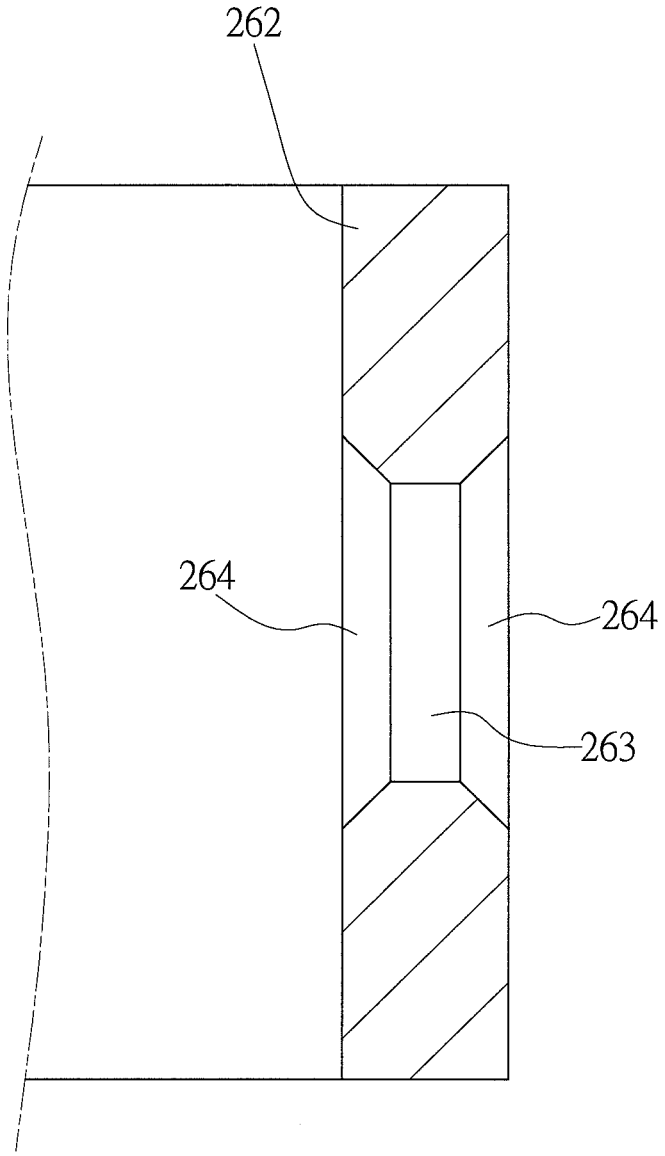
FIG. 7 is a sectional view taken along the line A-A in FIG. 6.

Furthermore, considering the fact that different users may have different stepping habits (including the angle at which a foot is placed), the foot-operated portion 32 of the pedal lever 31 of the cajón playing device 10 is bent toward the rear side of the user's foot and has a curved shape as shown in FIG. 4 to adapt to a range of foot placement angles. This allows the cajón playing device 10 of the present invention to accommodate different users' habitual stepping operations.

FIG. 5 to FIG. 8 show the cajón playing device 10 in the second embodiment of the present invention. This embodiment is different from the first embodiment in that the transmission member 26 is composed of a chain 261 and a linking member 262. The chain 261 is connected to the assembly block 231 of the rotating shaft 23. The linking member 262 is pivotally provided on the bottom plate 11 and can pivot with respect to the bottom plate 11.

The chain 261 has one end connected to the assembly block 231 of the rotating shaft 23 and the other end extending downward toward the bottom plate 11. The linking member 262 has a middle section pivotally provided on a supporting frame 15 of the bottom plate 11 so that the two opposite ends of the linking member 262 can pivot (or move up and down) with respect to the supporting frame 15 serving as a fulcrum. One of the two opposite ends of the linking member 262 is connected to the downwardly extending end of the chain 261 while the other end of the linking member 262 is bent toward and connected with the connecting portion 33 of the pedal lever 31. In the second embodiment, the connecting portion 33 of the pedal lever 31 is protrudingly provided with a stem 331, and the portion of the linking member 262 that connects with the connecting portion 33 is formed with a slot 263, which corresponds in position to the stem 331 and whose length D is greater than the diameter C of the stem 331. The stem 331 on the connecting portion 33 of the pedal lever 31 is inserted through the slot 263 of the linking member 262, with a fastener 332 fastened to the end of the stem 331 that is exposed through the slot 263, thereby connecting the connecting portion 33 of the pedal lever 31 to the linking member 262. In addition, each of the two open ends of the slot 263 has an inner edge with a flared surface 264.

Figure 8:
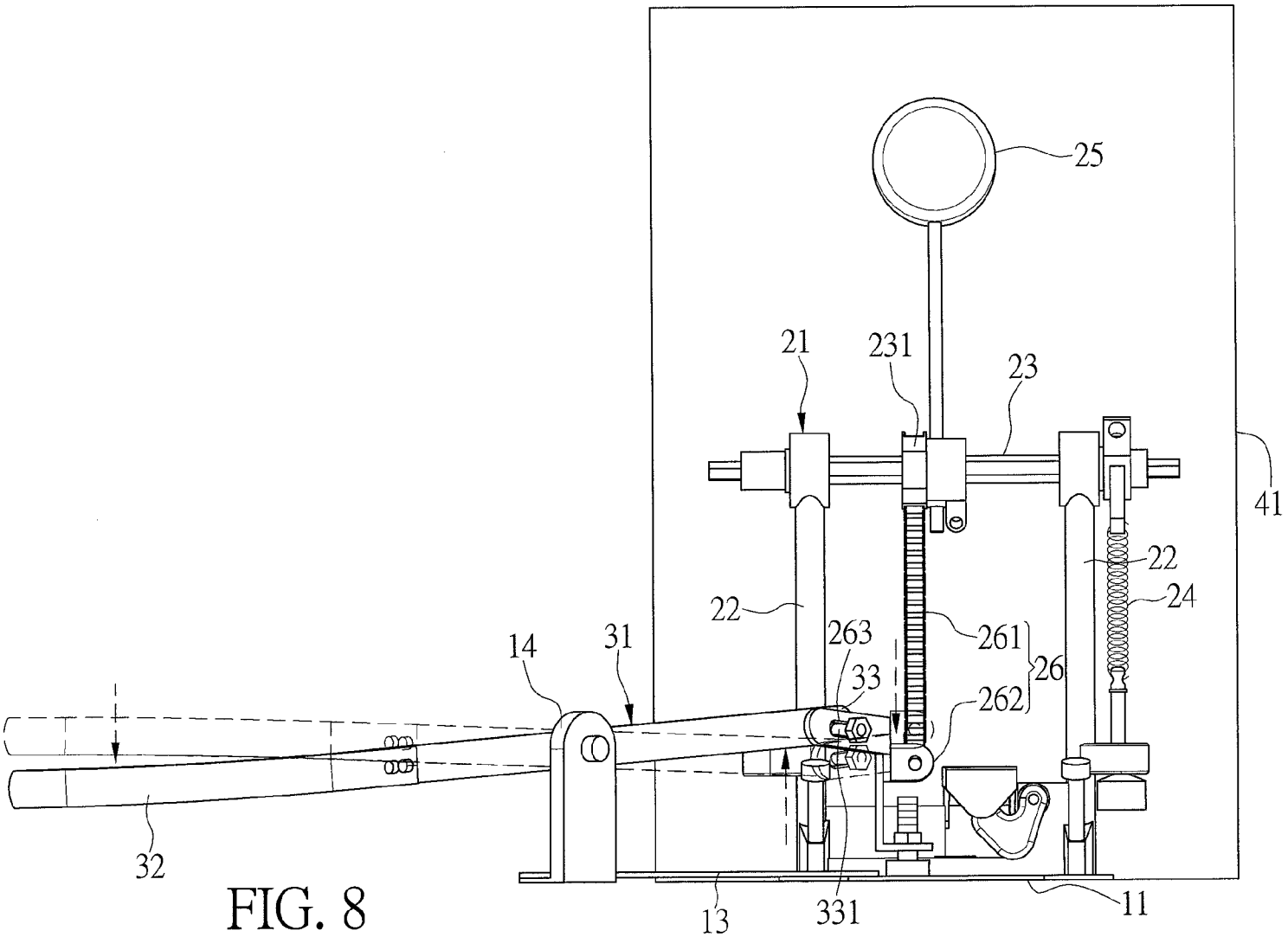
FIG. 8 is a front view showing how the pedal lever in the second embodiment of the present invention is operated.
Figure 9:
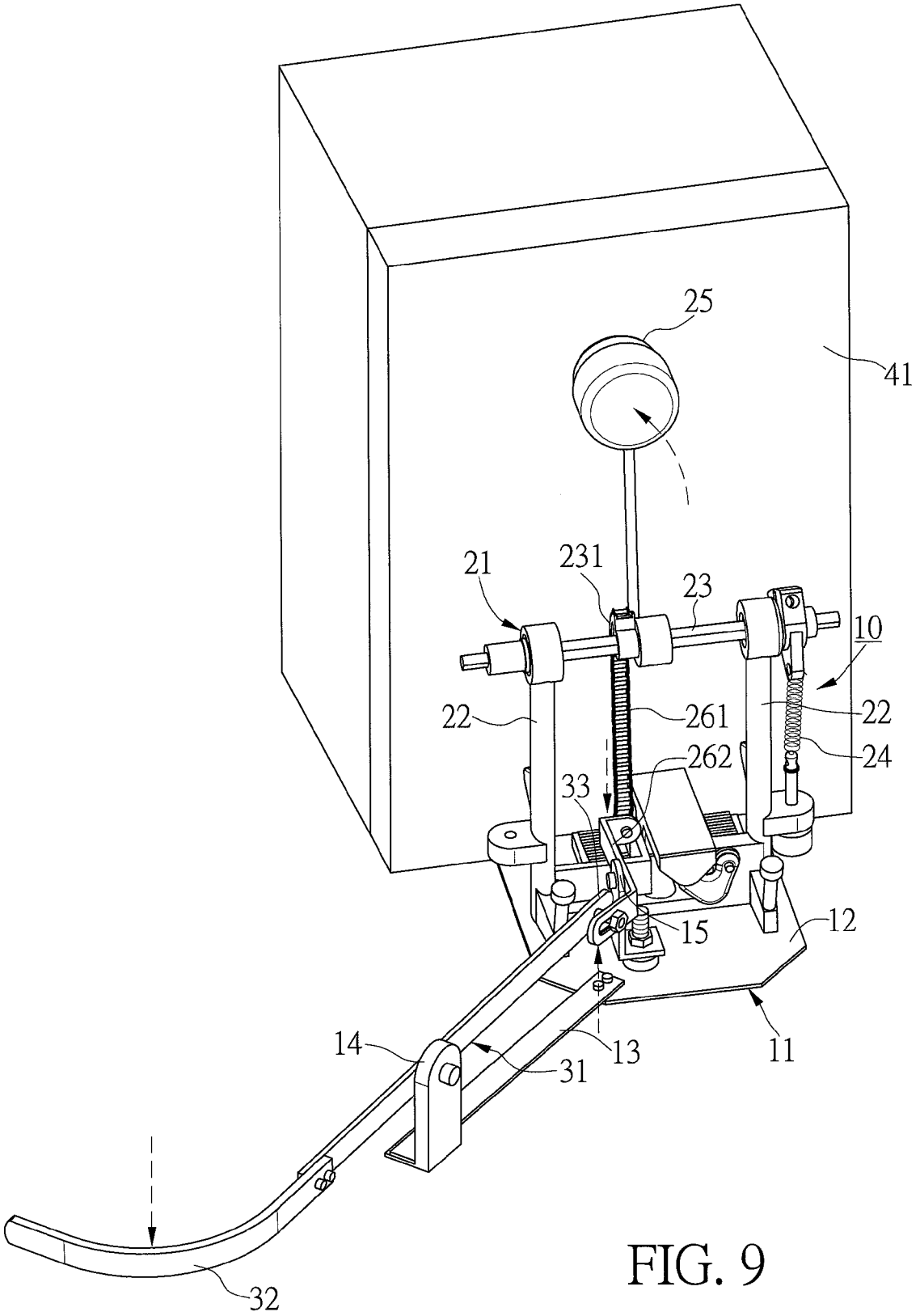
FIG. 9 is a perspective view showing how the pedal lever in the second embodiment of the present invention is operated.

To use the cajón playing device 10 in the second embodiment of the present invention, referring to FIG. 8 and FIG. 9, the user's foot steps down onto the curved foot-operated portion 32 of the pedal lever 31 to pivot the connecting portion 33 of the pedal lever 31 upward with respect to the pivotal connection portion 14 serving as a fulcrum. Since the connecting portion 33 of the pedal lever 31 is connected to one end of the linking member 262, the upward pivoting movement of the connecting portion 33 drives the linking member 262, which is connected to the connecting portion 33, to pivot with respect to the supporting frame 15 serving as a fulcrum. Consequently, the end of the linking member 262 that is connected to the chain 261 pulls the chain 261 downward and thereby rotates the assembly block 231 and the rotating shaft 23, and the mallet 25 fixedly connected to the rotating shaft 23 is pivoted and strikes the striking surface 41 of the cajón as a result. Like its counterpart in the previous embodiment, the cajón playing device 10 in the second embodiment features simple and durable components, low production costs, rapid assembly, and adaptability to different users' habitual stepping operations.

It should be pointed out that the pedal lever 31 and the linking member 262 in the second embodiment of the present invention are pivoted in different curved directions respectively, and that when the pedal lever 31 and the linking member 262 are driven to pivot by each other, therefore, the joint between them tends to be pulled and shifted. As the length D of the slot 263 is greater than the diameter C of the stem 331, and the inner edge of each of the two open ends of the slot 263 has the flared surface 264, a certain tolerance exists between the stem 331 and the slot 263 while the stem 331 is in the slot 263. The tolerance effectively ensures that the pedal lever 31 and the linking member 262 move smoothly when driven to pivot by each other.

Figure 10:
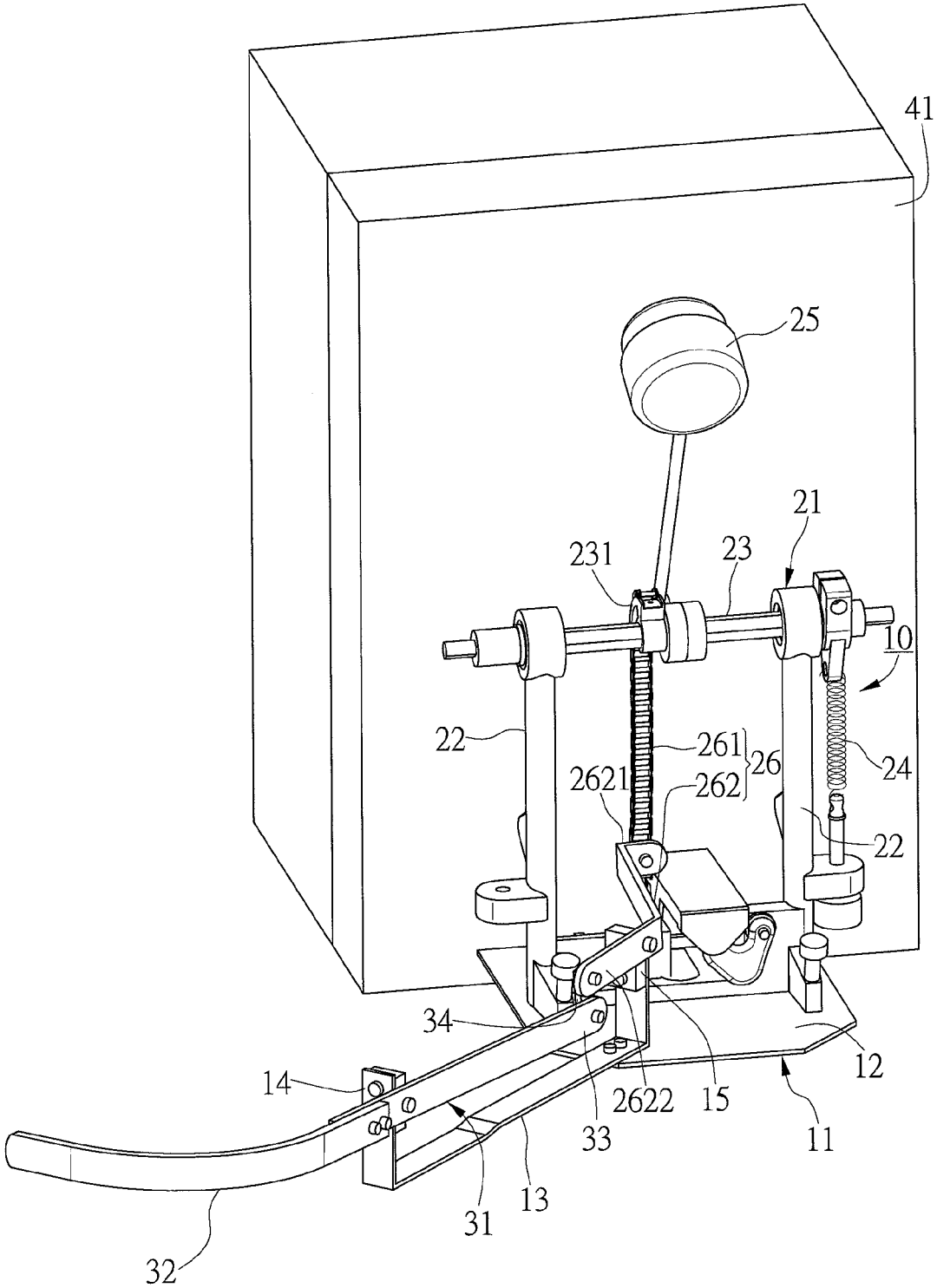
FIG. 10 is a perspective view of the third embodiment of the present invention.
Figure 11:
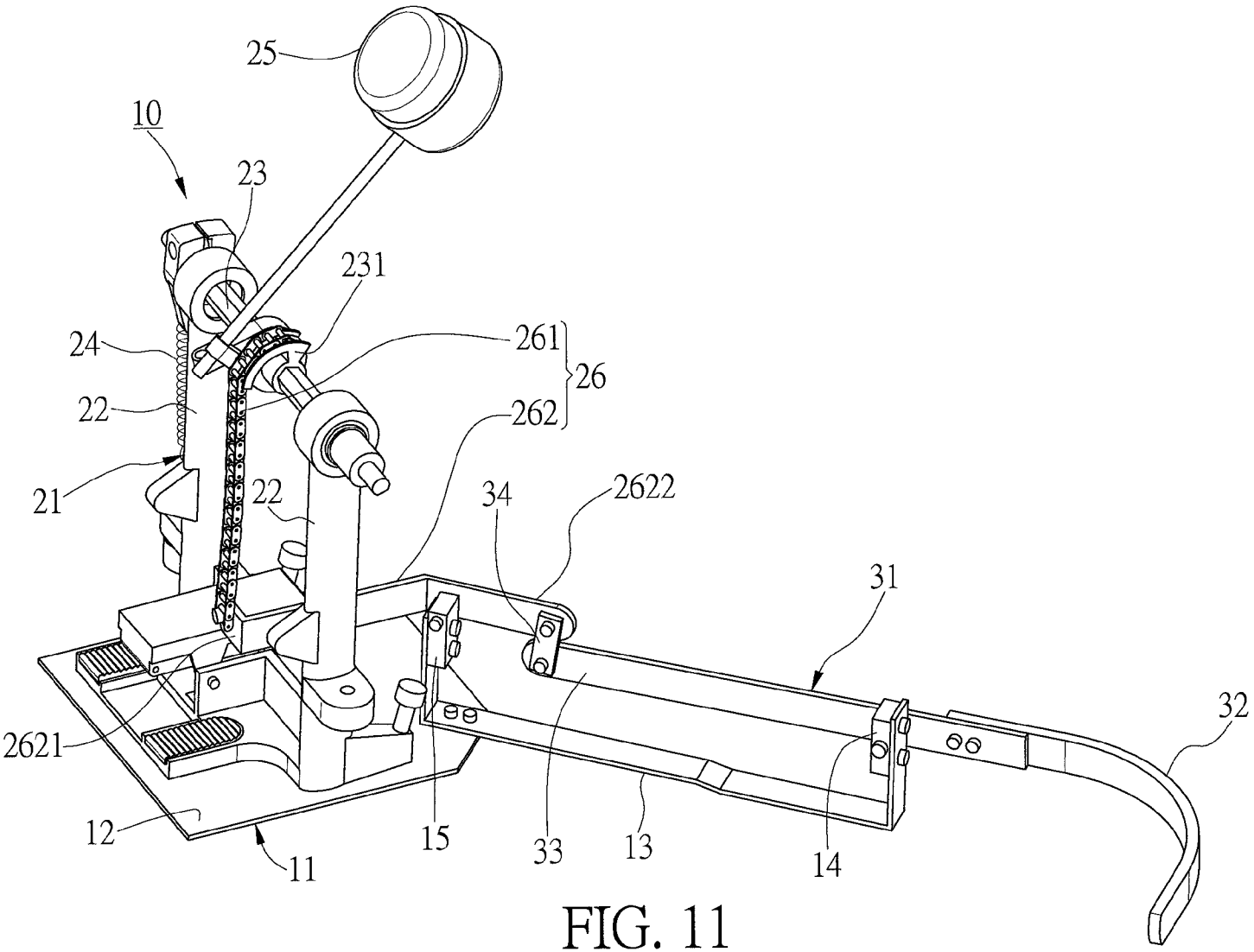
FIG. 11 is another perspective view of the third embodiment of the present invention.

FIG. 10 and FIG. 11 show the cajón playing device 10 in the third embodiment of the present invention. This embodiment is different from the first embodiment in that the transmission member 26 is composed of a chain 261 and a linking member 262. The chain 261 is connected to the assembly block 231 of the rotating shaft 23 while the linking member 262 is pivotally provided on the bottom plate 11 and can pivot with respect to the bottom plate 11.

The chain 261 has one end connected to the assembly block 231 of the rotating shaft 23 and the other end extending downward toward the bottom plate 11. The linking member 262 has a first end 2621 connected to the downwardly extending end of the chain 261 and a second end 2622 bent toward and pivotally connected to the connecting portion 33 of the pedal lever 31. A portion of the linking member 262 that is adjacent to the second end 2622 is pivotally provided on a supporting frame 15 of the bottom plate 11 so that the first end 2621 and the second end 2622 of the linking member 262 can pivot (or move up and down) with respect to the supporting frame 15 serving as a fulcrum. In the third embodiment, the second end 2622 of the linking member 262 is located above the connecting portion 33 of the pedal lever 31 and is pivotally connected to the connecting portion 33 via a pivotal connection plate 34 such that a certain pivoting tolerance exists while the connecting portion 33 and the second end 2622 of the linking member 262 are pivoted. The extension arm 13 of the bottom plate 11 has a generally square-U shape. More specifically, one end of the extension arm 13 is connected to the bottom plate 11 and bent upward to integrally form the supporting frame 15, and the other end of the extension arm 13 extends outward and is bent upward to integrally form the pivotal connection portion 14.

Figure 12:
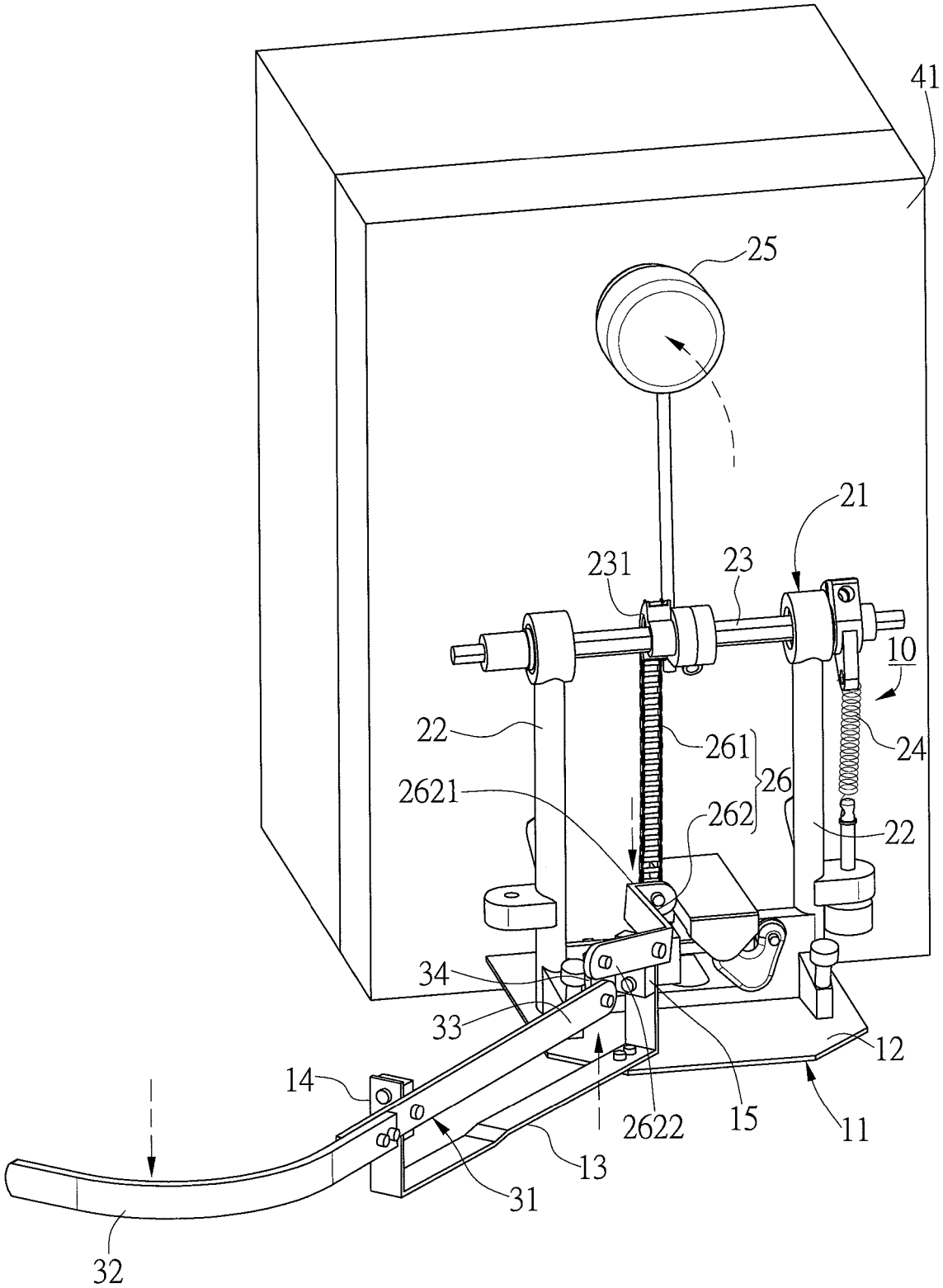
FIG. 12 is a perspective view showing how the pedal lever in the third embodiment of the present invention is operated.
Figure 13:
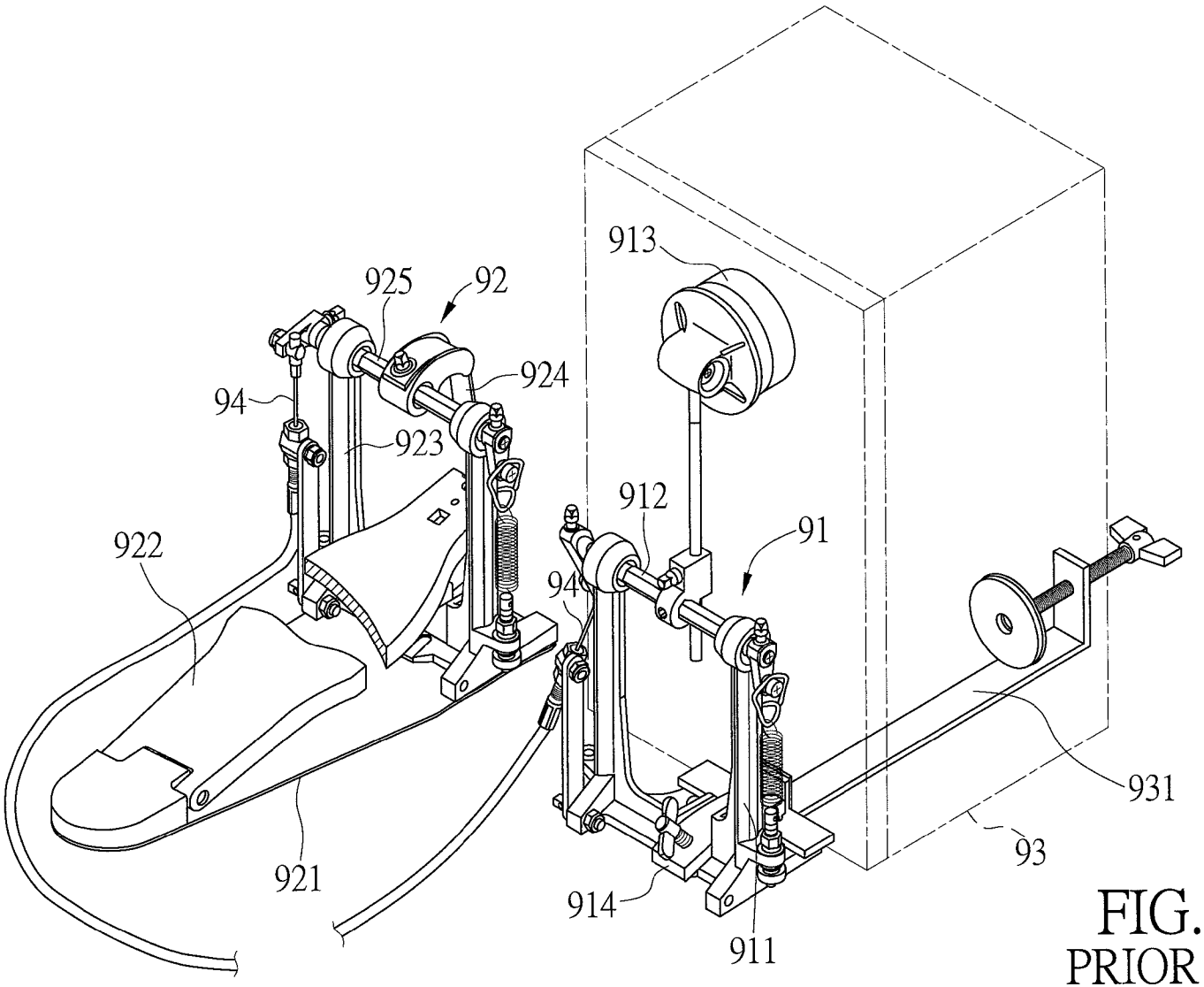
FIG. 13 PRIOR ART
FIG. 13 is a perspective view of a conventional cajón playing device.

To use the cajón playing device 10 in the third embodiment of the present invention, referring to FIG. 12, the user's foot steps down onto the curved foot-operated portion 32 of the pedal lever 31 to pivot the connecting portion 33 of the pedal lever 31 upward with respect to the pivotal connection portion 14 serving as a fulcrum. Since the connecting portion 33 of the pedal lever 31 and the second end 2622 of the linking member 262 are pivotally connected via the pivotal connection plate 34, the upward pivoting movement of the connecting portion 33 drives the second end 2622 of the linking member 262 to pivot with respect to the supporting frame 15 serving as a fulcrum. Meanwhile, the first end 2621 of the linking member 262, which end is connected to the chain 261, pulls the chain 261 downward and thereby rotates the assembly block 231 and the rotating shaft 23. The mallet 25 fixedly connected to the rotating shaft 23 is thus pivoted and strikes the striking surface 41 of the cajón. Like its counterparts in the previous embodiments, the cajón playing device 10 in the third embodiment features simple and durable components, low production costs, rapid assembly, and adaptability to different users' habitual stepping operations.

What is claimed is:

1. A cajón playing device, to be provided in front of a striking surface of a cajón, the cajón playing device comprising:

a bottom plate having a supporting surface, the bottom plate having a lateral side provided with an outwardly extending extension arm, the extension arm having a pivotal connection portion;

a mallet assembly mounted on the supporting surface of the bottom plate, wherein the mallet assembly has two vertically provided posts; a rotating shaft pivotally provided between and pivotable with respect to the two posts; an extension spring connected to an end of the rotating shaft so that, once the rotating shaft is rotated from an original position, the extension spring is able to rotate the rotating shaft reversely back to the original position; a mallet fixedly connected to the rotating shaft so as to pivot simultaneously with the rotating shaft when the rotating shaft is rotated; and a transmission member fixedly connected to the rotating shaft and extending toward the bottom plate; and a pedal lever pivotally provided on the pivotal connection portion of the extension arm such that the pivotal connection portion serves as a fulcrum of the pedal lever, the pedal lever having an end defining a foot-operated portion to be stepped on and operated by a foot and an opposite end defining a connecting portion, wherein the connecting portion is connected to an extending end of the transmission member, the foot-operated portion is bent toward a rear side of the foot and has a curved shape, and when the foot is placed on the foot-operated portion and moves the foot-operated portion up and down, the connecting portion is pivoted with respect to the pivotal connection portion serving as the fulcrum and thereby drives the transmission member to rotate the rotating shaft such that the mallet fixedly connected to the rotating shaft is pivoted and strikes the striking surface of the cajón.

2. The cajón playing device of claim 1, wherein the transmission member is composed of a long, flat, plate-shaped pushrod, and the transmission member has an end pivotally provided on an assembly block of the rotating shaft and an opposite end extending downward toward the bottom plate and pivotally connected to the connecting portion of the pedal lever.

3. The cajón playing device of claim 1, wherein the transmission member is composed of a chain connected to the rotating shaft and a linking member pivotally provided on the bottom plate, the chain has an end connected to the rotating shaft and an opposite end extending downward toward the bottom plate, the linking member has a middle section pivotally provided on a supporting frame of the bottom plate and two opposite ends pivotable with respect to the supporting frame serving as a fulcrum, one said end of the linking member, is connected to the end of the chain that extends downward toward the bottom plate, and the other end of the linking member is bent toward and connected to the connecting portion of the pedal lever.

4. The cajón playing device of claim 3, wherein the connecting portion of the pedal lever is protrudingly provided with a stem, the linking member has a portion connected to the connecting portion and formed with a slot, the slot corresponds in position to the stem and has a length greater than a diameter of the stem, the stem on the connecting portion of the pedal lever is inserted through the slot of the linking member and has an end exposed through the slot and fastened with a fastener such that the connecting portion of the pedal lever and the linking member are connected, and the slot has two open ends each having an inner edge with a flared surface.

5. The cajón playing device of claim 1, wherein the transmission member is composed of a chain connected to the rotating shaft and a linking member pivotally provided on the bottom plate; the chain has an end connected to the rotating shaft and an opposite end extending downward toward the bottom plate; and the linking member has a first end connected to the end of the chain that extends downward toward the bottom plate, a second end bent toward and pivotally connected to the connecting portion of the pedal lever, and a portion adjacent to the second end of the linking member and pivotally provided on a supporting frame of the bottom plate so that the first end and the second end of the linking member are pivotable with respect to the supporting frame serving as a fulcrum.

6. The cajón playing device of claim 5, wherein the second end of the linking member is located above the connecting portion of the pedal lever and is pivotally connected to the connecting portion via a pivotal, connection plate.

7. The cajón playing device of claim 5, wherein the extension arm of the bottom plate has an end connected to the bottom plate and bent upward to integrally form the supporting frame, and the extension arm has an opposite end extending outward and bent upward to integrally form the pivotal connection portion.

* * * * *